US009583026B2

(12) United States Patent
Tremolada et al.

(10) Patent No.: US 9,583,026 B2
(45) Date of Patent: Feb. 28, 2017

(54) SECURE MULTILAYER LABEL AND ASSOCIATED MANUFACTURING METHOD

(71) Applicant: Hologram Industries, Marne la Vallée (FR)

(72) Inventors: Fabio Tremolada, Milford, CT (US); Hugues Souparis, Paris (FR); Georges Houston, West Haven, CT (US)

(73) Assignee: HOLOGRAM INDUSTRIES, Marne la Vallee (FR)

( * ) Notice: Subject to any disclaimer, the term of this patent is extended or adjusted under 35 U.S.C. 154(b) by 80 days.

(21) Appl. No.: 14/363,486

(22) PCT Filed: Dec. 4, 2012

(86) PCT No.: PCT/FR2012/052792

§ 371 (c)(1),
(2) Date: Jun. 6, 2014

(87) PCT Pub. No.: WO2013/093277

PCT Pub. Date: Jun. 27, 2013

(65) Prior Publication Data

US 2014/0333058 A1 Nov. 13, 2014

(30) Foreign Application Priority Data

Dec. 7, 2011 (FR) ..... 11 61277

(51) Int. Cl.

| | |
|---|---|
| ***B42D 25/00*** | (2014.01) |
| ***G09F 3/03*** | (2006.01) |
| ***G09F 3/00*** | (2006.01) |
| *G09F 3/02* | (2006.01) |

(52) U.S. Cl.

CPC ..... *G09F 3/03* (2013.01); *B42D 25/00* (2014.10); *G09F 3/0288* (2013.01); *G09F 3/0292* (2013.01); *G09F 2003/0257* (2013.01)

(58) Field of Classification Search

CPC ..... G09F 3/0292; B42D 2033/40; B42D 2033/42

USPC ..... 283/81

See application file for complete search history.

(56) References Cited

U.S. PATENT DOCUMENTS 5,165,725 A * 11/1992 Gollon ..... G09F 3/0292 283/81
5,294,470 A * 3/1994 Ewan ..... B65D 55/026 229/102
5,319,475 A * 6/1994 Kay ..... G09F 3/0292 283/108
5,510,171 A * 4/1996 Faykish ..... B32B 27/08 428/32.62

(Continued)

*Primary Examiner* — Kyle Grabowski

(74) *Attorney, Agent, or Firm* — Abelman, Frayne & Schwab

(57) ABSTRACT

The invention relates to a prefabricated secure foldable multilayer label intended to be adhered onto a substrate, including built-in security means (13, 23), characterized in that it includes a first flap (1) and a second flap (2), each including a transparent substrate layer (11, 21), said flaps being separated by a folding line and capable of overlapping and being adhered along a first surface (61, 62) of said flaps (1, 2). According to one advantageous aspect, the prefabricated label includes a removable printable sheet (4), which can be used e.g. as a receipt. The invention also relates to the manufacture of said secure label.

13 Claims, 3 Drawing Sheets

(56) References Cited

U.S. PATENT DOCUMENTS

| | | | | |
|---|---|---|---|---|
| 5,683,774 | A * | 11/1997 | Faykish | G09F 3/0292 283/81 |
| 6,019,395 | A * | 2/2000 | Souparis | G09F 3/0292 283/94 |
| 6,514,587 | B1 * | 2/2003 | Fernandez-Kirchberger | B42D 25/00 283/81 |
| 2004/0209028 | A1 * | 10/2004 | Gosselin | B32B 27/08 283/81 |

* cited by examiner

SECURE MULTILAYER LABEL AND ASSOCIATED MANUFACTURING METHOD

CLAIM FOR PRIORITY

This application claims priority to PCT/FR2012/052792, filed 27 Jun. 2013, which claims benefit to French Application No. 11 61277, filed on 7 Dec. 2011.

TECHNICAL FIELD OF THE INVENTION

The present invention concerns destructible secure marking labels for authenticating and identifying in a visible (or partially encoded) manner data and information affixed to a carrier such as a glass wall. For example, it may be a case of car registration stickers, insurance discs, technical inspection discs, or tax discs intended to be stuck to a car windscreen or to an official document. The terms "discs" and "labels" can be considered to be synonyms.

In the case of a disc for a car windscreen, the disc is normally stuck inside the vehicle and must be visible from the outside.

These labels exhibit, in use, general information supplemented by specific information particular to the user or to his vehicle. Personalisation or identification is then spoken of in order to designate the inscription of this information on the label.

In this field, one important parameter consists of an anti-fraud security measure. This is because it is important for these data or this information to be fixed definitively while preventing any possibility of falsification and/or misappropriation and/or reproduction of the label. "Falsification" means a modification to the data or information on the label. "Misappropriation" or "diversion of use" (misuse attack) means detachment of the label vis-à-vis the carrier on which it is properly affixed; and then its affixing to another carrier.

Thus the resistance to fraud of such labels is a very important criterion. The label presented here makes it possible to respond to fraud by falsification of data; to fraud by diversion of use, that is to say when the label is detached and re-stuck elsewhere, and/or to fraud by reproduction in particular through the presence of a hologram that represents a technological barrier. Fraud by reproduction is generally referred to as counterfeit in the field in question.

Moreover, this type of label is generally produced by specialists in the establishment of security means which, when the labels are manufactured, include said information or data in the label in itself.

PRIOR ART

Some documents of the prior art also propose labels not intended for the above technical field. For example, from the patent EP 0917124 B1, a self-adhesive label is known with two foldable flaps, where the first flap has an inscription area consisting of a metallised polymer sheet marked by pressure, and the second flap comprises an adhesive intended to come into contact with the inscription area.

In this label, the metallised inscription area is protected by the second flap but this label does not comprise any security means preventing falsifications and/or misappropriations and/or reproductions. Furthermore, the metallised sheet is marked by pressure, which is not satisfactory in the technical field mentioned above.

The documents of the prior art also propose so-called security labels and discs. However, these labels and discs are not sufficiently satisfactory.

For example, from the patent application FR 2 862 416 A1, a complex sheet is known for producing a security label, the complex sheet consisting of: a sheet supporting an informative adhesive transparent label; a protective adhesive label; and means for making visible the removal or attempt at removal of said adhesive label. The security label is produced by detaching the protective adhesive label from the support sheet and sticking it to the personalised informative adhesive transparent label. The assembly consisting of informative adhesive transparent label and protective adhesive label is used for secure marking and the support sheet is scrapped.

Such a label does not prove completely satisfactory since the positioning of the informative adhesive transparent label on the protective adhesive label at the personalised area is done manually without any locating and/or guiding means. Thus errors in positioning the protective adhesive label may occur, which gives rise to problems of a technical and/or aesthetic nature.

Also, from the patent EP 0 886 849 B1, a personalisable secure marking system is also known for producing a secure marking label, consisting of a support sheet such as a silicone-coated sheet having two flaps separated by a folding line. The first flap supports, on the front face, a first holographic component and an adhesive layer, and the second flap supports on the reverse face a second component formed by a film and an adhesive layer; at least the opposite (front) face of the second flap carries official inscriptions.

This system is not satisfactory since it gives rise to high costs, in particular in the production of the support sheet, which subsequently does not form part of the label. This is because producing the label before personalisation requires a certain number of steps of different natures that cannot be carried out on a production line and therefore prove to be expensive.

From the application WO 2007/036617, a secure marking system is also known for producing a secure marking label, comprising a support sheet such as a silicone-coated sheet having two flaps and folding lines for a so-called "zigzag" folding. The first flap supports, on the front face, a first holographic component and an adhesive layer, and the second flap supports, on the same front face, a second component formed by a film that has personalisation inscriptions, and an adhesive layer. During the zigzag folding, the component of the first flap is glued to the component of the second flap in order to form the secure label.

This system does not prove to be satisfactory since it involves high costs in particular because the two components consist of the same materials (adhesive and holographic film) and the holographic film is in itself a complex and expensive product.

A secure marking label for a transparent carrier, such as a motor vehicle windscreen, is also known from the patent EP 0 868 713 B1. The label contains information specific to the carrier marked. The label is composed of a complex formed from two superimposed elements between which a marking element is interposed, at least one of said marking elements comprising a diffraction grating.

The implementation of the personalisation and sealing of this label is done in a complex manner, in particular by the placing of the various layers of the label by two labelling machines.

In addition, the labels of these documents do not provide a second medium such as a receipt or a counterfoil that includes personalised information of the label. Such a receipt is handed to the user of the label or kept by the body responsible for producing the label.

DISCLOSURE OF THE INVENTION

The invention aims in particular to remedy the drawbacks of the prior art disclosed above.

To do this, a foldable prefabricated multilayer secure label intended to be glued to a carrier is proposed, comprising integrated security means.

"Secure label" means a label using anti-fraud security means, in particular anti-falsification and/or anti-misappropriation security means and/or means for preventing reproduction of said label.

According to a first aspect, the label comprises a first flap and a second flap, each comprising a continuous layer of a transparent substrate, separated by a folding line and able to overlap on a first face of said flaps, and in which:

- the first flap comprises at least a first adhesive layer disposed opposite a first face of the transparent substrate, and protected by a first removable protective layer on its face opposite to the substrate, said first adhesive layer making it possible to stick together the two flaps when they are folded one on the other,
- the second flap comprises, on a first face of the transparent substrate, a surface printable material, preferably a printable varnish,
- one of said flaps further comprises at least a second adhesive layer disposed on a second face of the transparent substrate and protected by a second removable protective layer on its face opposite to the substrate, said second adhesive layer making it possible to stick the label on the support.

Advantageously, the two flaps have a rigidity such that the document can pass through a printer without suffering deformation or risking creasing in the machine. The rigidity of the flaps is obtained by means of the use of a suitable sheet for the removable protective layer. This type of sheet generally consists of a multilayer assembly and is known to persons skilled in the art by the term "layflat".

According to another aspect of the invention, the first removable protective layer comprises a printable sheet. In particular the printable sheet is disposed on the face opposite to the face in contact with the adhesive, which is coated with an anti-adhesion treatment. Thus, in this embodiment, it is possible to produce the label according to the invention in one printing step on the first face of said flaps.

Thus, according to a preferred variant of the invention, the label makes it possible to print a set of data both on the printable varnish and on the removable printable sheet.

Moreover, it proves advantageous to be able to keep said sheet as receipt or counterfoil for handing to the user or keeping by the body responsible for the printing and the sealing of the secure label.

In addition, according to the invention, neither the printing nor the sealing of the label requires specialised equipment but only a printing means such as a printer (for example an office inkjet printer or a laser printer or a thermal transfer printer).

According to a highly advantageous variant, the security means comprise at least one destructible coloured complex layer interposed between the first face of the transparent substrate of the first flap, and the first adhesive layer.

The "destructible coloured complex" means for example a set of layers that are sufficiently opaque to provide a base that enables the information to be read. The destructible coloured complex advantageously allows protection of the label, once folded and glued on itself, against falsification. This is because any attempt at unsticking the two flaps causes the destructible coloured complex to disintegrate.

Preferably, the printable material is translucent or transparent, the coloured complex layer is opaque and said second adhesive layer is provided on the second face of the transparent substrate constituting the second flap.

In a variant, it is also possible to provide for the printable material to be opaque, the coloured complex layer is translucent and said second adhesive layer is provided on the second face of the transparent substrate of the first flap.

In a variant, provision can be made for the coloured complex to comprise reagents, in particular inks, having a specific behaviour in the presence of solvents so as to detect any chemical attack aimed at dissolving the adhesive.

Advantageously, the security means comprise a hologram integrated in the second adhesive layer.

Thus the hologram enables the label to be made secure, once glued against the carrier, against misappropriation. This is because any attempt at unsticking the label from the carrier causes partial destruction of the hologram placed in the second adhesive layer.

The label may also comprise a holographic layer, for example a layer of holographic varnish.

Advantageously, the label may comprise at least one RFID chip in one of said layers.

Preferably, the label comprises at least one RFID chip placed alongside or in place of the hologram.

Advantageously, a method of use may be pre-printed on the second protective layer. Thus, the user of the layer can take cognisance of the method of sealing the label.

The invention also relates to a method for personalising and sealing a secure label described previously, comprising steps for:

- printing a set of identification data to be protected on the printable material and preferably on the printable sheet of the first protective layer,
- removing the first protective layer, preferably the printable sheet of the label, so that the first adhesive layer can be positioned facing said printable material,
- folding and gluing the first and second flaps by applying the first adhesive layer against the printable material, preferably the printable varnish.

Advantageously, the printing step may comprise the printing of a barcode, in particular a 2D code of the QRCode or datamatrix type in addition to the identification data.

Preferably, the printing step is performed as windowphanie on printable material, preferably printable varnish.

Advantageously, the inks used for the printing are security inks having for example fluorescence or phosphorescence characteristics or including chemical tracers.

Alternatively, security inks having reagents reacting to chemical products such as polar or apolar solvents can be used.

Advantageously, the method comprises a removal of the second protective layer and then a fixing of the label on the carrier by applying the second adhesive layer to the carrier.

According to the invention, the term "print" and declinations thereof may be understood as manual inscription.

Another subject matter of the invention consists of a personalised sealed secure label intended to be glued to a carrier, comprising label security means, characterised in that it comprises a first flap and a second flap separated by a folding line that each comprise a transparent substrate layer and overlap each other on a first face, and in which:

the first flap comprises at least one first adhesive layer arranged facing a first face of the transparent substrate, and designed to glue the two flaps folded one on the other, the second flap comprises, on the first face of the second transparent substrate, a surface printable material, preferably a printable varnish, on which identification data are printed, one of said flaps further comprises at least a second adhesive layer disposed on a second face of the transparent substrate and protected by a second removable protective layer on its face opposite to the substrate, said second adhesive layer making it possible to stick the label on the support.

Advantageously, the printable varnish may comprise a barcode, in particular a 2D code of the QRCode or datamatrix type, printed in addition to the identification data.

BRIEF DESCRIPTION OF THE FIGURES

Other features, details and advantages of the invention will emerge from a reading of the following description, with reference to the accompanying figures, which illustrate.

For more clarity, identical or similar elements are referenced by identical reference signs in all the figures.

DETAILED DESCRIPTION OF AN EMBODIMENT

Figure 1:
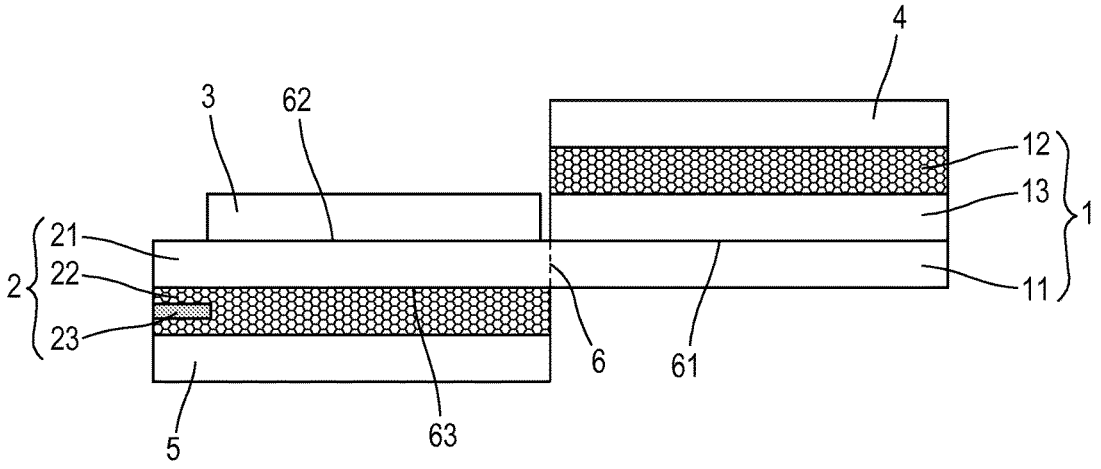
FIG. 1, a diagram of a secure label according to a preferred variant of the invention, in unfolded form.

Referring to FIG. 1, the secure label according to a preferred variant of the invention consists of a multilayer structure. This layer has a first flap 1 that comprises a transparent substrate 11 on the first face 61 of which a layer of destructible coloured complex 13, a first adhesive layer 12 and a printable protective sheet 4 are provided in succession. Thus the printable protective sheet 4 constitutes the surface layer of the first face 61 of the first flap 1 of the label.

According to this variant, the secure label also has a second flap 2 that comprises a transparent substrate 21 provided with a printable varnish 3 on its first face 62. The second face 63 of the substrate 21 is covered with an adhesive layer 22 in which a hologram 23 is preferentially integrated. The layer 22 is covered with a second protective layer 5. Thus the printable varnish 3 constitutes the surface layer of the first face 62 of the second flap 2 of the label. A folding line 6 is provided between the two flaps 1, 2. The folding line 6 comprises for example perforations that facilitate the folding of the two flaps constituting the label.

It is therefore clear that a part 11 of the transparent substrate constitutes the first flap 1 while the other part 21 of the transparent substrate constitutes the second flap 2. The two parts 11 and 21 constitute here a second continuous layer of the transparent substrate. The two flaps are connected together by the folding line 6 forming a hinge.

Figure 2:
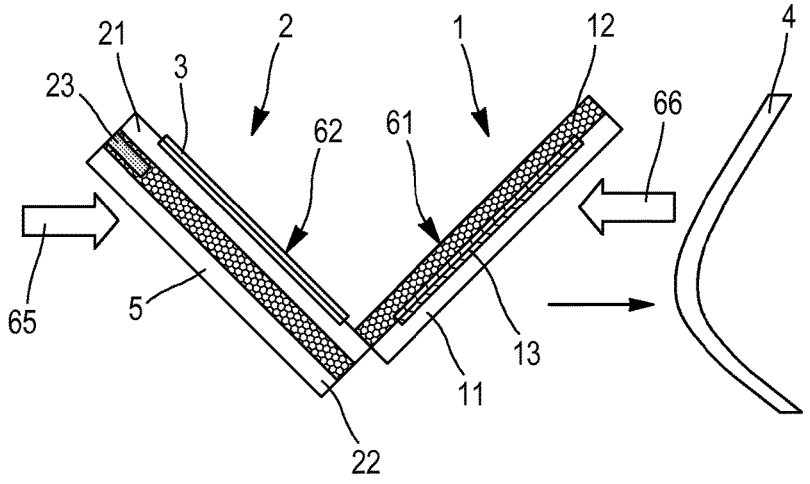
FIG. 2, a diagram of the intermediate folding and sealing of the label of FIG. 1.

FIG. 2 illustrates an intermediate step of the method for manufacturing a sealed secure label according to the invention. In this figure, the personalised removable printable sheet 4 is detached, which reveals the first adhesive layer 12. The flaps 1 and 2 are then folded one on the other at the folding line 6, on their front faces (61 and 62), along the arrows (65 and 66), in order to be glued by means of the adhesive layer 12.

The method for manufacturing a sealed secure label according to a preferred variant comprises the following steps:

The first step is a step of personalising the label by printing. During this step, variable information such as data relating to a person or data particular to an object are inscribed either manually, or by office equipment, on the printable varnish 3.

It should be noted that part of the printable varnish is personalised in reverse (windowphanie) so as to be read from the outside of the carrier, unlike the printable sheet 4, which will be personalised in the normal reading direction.

The second step comprises, after personalisation, a detachment of the printable protective sheet 4 vis-à-vis the first flap 1. The printable protective sheet 4 is for example returned to the user who will use the label. It can also be preserved by the body responsible for the personalisation and sealing of the label.

The third step is the formation of the secure sticker: the document is folded on itself, in the direction of the arrows 65 and 66, along the folding line 6, and then the faces 61 and 62 are glued one on the other so as to seal and protect the information printed on the printable varnish 3. In this way, a secure label is formed.

Finally, the last step is a handing of the label thus sealed to the user in order to stick it on a suitable carrier.

Figure 3:
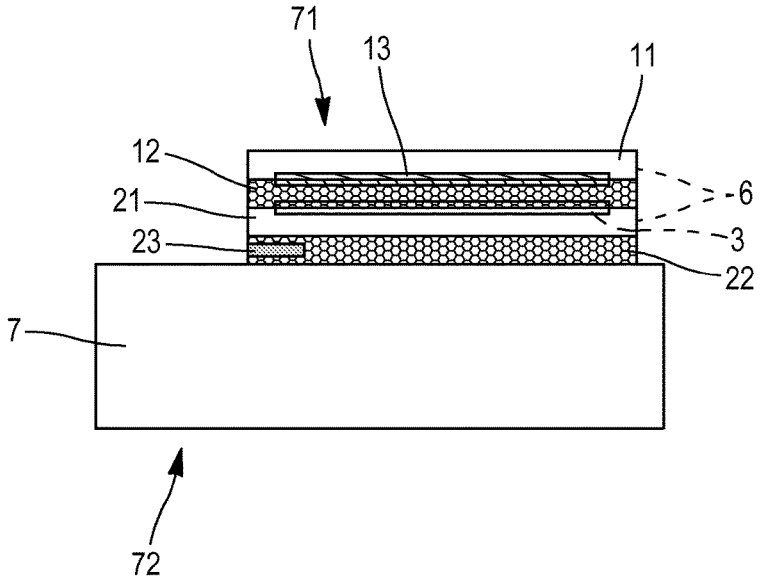
FIG. 3, a cross-section of a sealed label glued against a carrier.

Referring to FIG. 3, the sealed label is stuck against a carrier such as a car windscreen 7, on the inside 71, in order to be visible from the outside 72. It has a hologram 23 integrated in the adhesive layer 22, itself in direct contact with the windscreen 7. The destructible coloured complex 13 then constitutes the innermost second layer of the label. The reference 6 represents schematically the connection between the transparent substrates 11 and 21 following the folding and sealing.

Figure 4:
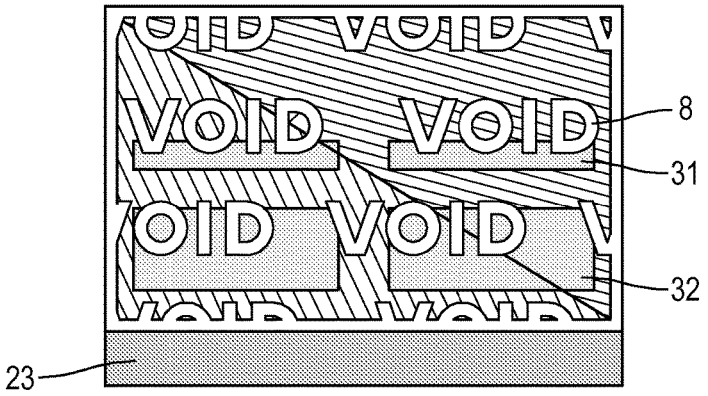
FIG. 4, a front view of a sealed label after an attempt at falsification.

Referring to FIG. 4, the destructible coloured complex 13 according to a preferred variant enables the label to be protected against falsification. This is because an attempt at unsticking the two flaps 11, 21 of a sealed label constitutes evidence of an attempt at falsification illustrated in FIG. 4. As can be seen in this figure, it is possible to configure the label so that a sublayer, for example of wax, forms a text that will constitute said evidence of falsification 8. The references 31 and 32 illustrate an example of personalisation zones. The layer of coloured complex shown in FIGS. 4 and 5 comprises two sublayers of different colours disposed side by side. The colours are represented by hatching. Naturally, these sublayers can also be completely or partially superimposed, as shown in FIGS. 2 and 3.

Figure 5:
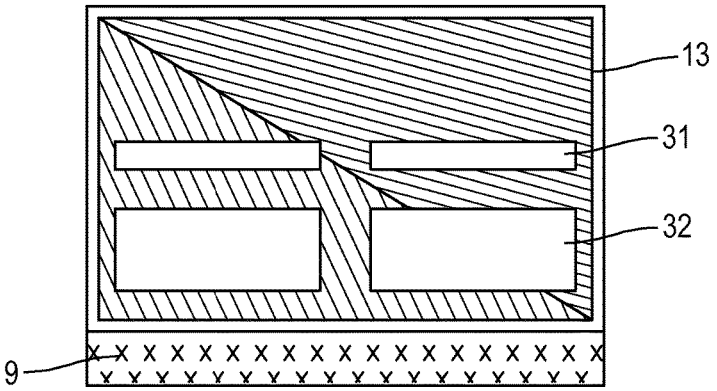
FIG. 5, a front view of a sealed label after an attempt at misappropriation.

Referring to FIG. 5, the hologram 23 according to a preferred variant protects the label against misappropriation. This is because an attempt at unsticking the label vis-à-vis its carrier 7 shows evidence of an attempt at misappropriation illustrated in FIG. 5. As can be seen in this figure, it is possible to configure the label so that a layer of metal forms characteristic patterns 9 that will constitute said evidence of misappropriation. Thus, in the case of an attempt at unsticking the label vis-à-vis its carrier, the holographic element 23 will be destroyed according to a predefined pattern 9 (for example "x's").

As can be seen in FIGS. 4 and 5, the label is configured so that the hologram 23 and/or the destructible coloured complex 13 are at least partially visible in use.

The substrate (11, 21) is preferably a plastic sheet, for example of the polyethylene (PET) type. The typical thickness of the layer of substrate (11, 21) is approximately 50 μm. The substrate 21 coated with the varnish 3 is compatible with printing, preferably laser (without contraction, without deformation), inkjet or thermal printing. It is preferable for the thickness of the layer of substrate to be as thin as possible in order to have an easily manipulatable product.

The printable varnish 3 is preferably a varnish that is crosslinkable under UV or one with a water base. This varnish 3 can be applied locally by flexographic printing or any other technique known to persons skilled in the art. This varnish makes it possible indirectly to make the substrate printable with printing means such as an office printer, preferably laser. Naturally, the invention is not limited to the use of a printable varnish. The printable layer can be integrated in the support film over its entire surface. Any other printable material can be used instead of the printable varnish 3 without departing from the scope of the invention.

The printable varnish 3 is preferably applied locally in the area provided for the personalisation of the document.

The destructible coloured complex 13 is preferably sufficiently opaque to provide a base that enables the information to be read. It can be produced using colours guaranteeing a good contrast with the printing of the variable data. In the event of an attempt at separation of the layers of the label to access the personalisation data with a view to falsifying them (see FIG. 4), the destruction of the sublayers of the complex irreversibly reveals a characteristic pattern visible both on one face or the other of the carrier 7, in particular from the inside or outside of the vehicle.

Methods for producing destructible coloured complexes are described in the prior art. They comprise for example layers put in place by lamination. The sublayers of the destructible coloured complex 13 can also be placed directly on the structure of the label by successive printings of said sublayers. By way of illustration, the destructible coloured layer 13; 14 used in the invention comprises successively the following sublayers:

- a sublayer of structured transparent wax deposited on the substrate 11;
- one or more coloured sublayers.

The production of the sublayers of the destructible coloured complex 13; 14 comprises for example printing of a release layer based on transparent silicone on the substrate 11 and over the colours. There are no colour constraints for the functionality, but contrasted colours are advantageously used to limit the discolouration due to exposure to UV and to guarantee the legibility of the personalisation information. It is also possible, in the case of dark colours, to use white printing if this is compatible both with the printing method and with the colour of the protective printable sheet 4.

The first adhesive layer 12 is preferably applied by so-called hot-melt coating or by so-called roller coating or by lamination and transfer of an adhesive film. This layer comprises for example a permanent acrylic adhesive. The thickness of the first adhesive layer 12 is variable advantageously between 15 and 60 μm, so as to allow optimum holding of the printable sheet 4 on the coloured complex 13.

The removable printable sheet 4 has a dual function:

- the face thereof in direct contact with the first adhesive layer 12 is silicone coated or coated with any anti-adhesion covering and serves as a temporary protector for the adhesive 12;
- the second face thereof opposite to the adhesive 12 can be printed with the same printing means as the printable varnish 3, 33.

The sheet 4 can advantageously serve as a receipt (see step 2) and is typically a protector of the "layflat" type made from paper.

The second adhesive layer 22 is applied by the same means as the first adhesive layer 12. Thus a permanent acrylic adhesive can be used to afford optimum holding of the substrate on the carrier. The second adhesive layer 22 may have a composition identical to or different from that of the first adhesive layer 12.

Preferably the second protective layer 5 is coated on its face in contact with the second adhesion layer 22, with silicone or any other anti-adhesive coating; the second protective layer 5 serves as a protector for the second adhesive layer 22.

Advantageously, the face of the protective layer 5 opposite to the adhesive can be printed. This printing is not necessarily personalised. It may for example indicate the operating method of the product.

In addition, a destructible holographic element 23 is preferentially incorporated in the secure label according to the invention, by the deposition of a holographic label or an adhesive holographic track 23 continuously. The holographic element 23 may also be incorporated by cold transfer, or hot. In a preferred variant the holographic element 23 is disposed on the face of the second flap 2 intended to come into contact with the support 7, between the substrate 21 and the second adhesive layer 22.

Methods for producing a hologram are described in general terms in the prior art. They comprise for example sublayers placed by lamination and generally a metallic layer that is placed by vacuum evaporation. The hologram 23 used in a preferred variant of the invention comprises successively the following layers:

- a sublayer of substrate, preferably made form polyester,
- a wax or silicone sublayer (referred to as "for partial detachment"),
- a microstructured resin sublayer,
- a metal sublayer conventionally made from aluminium, copper or other,
- a type 22 adhesive sublayer,
- and optionally a removable protective sublayer.

The implementation of the hologram comprises for example an application of a destructible adhesive holographic track by lamination on the face 63 of the substrate 21. The adhesion is achieved by means of the sublayer 22, and then the adhesive layer 22 is applied so that the hologram 23 is integrated in the adhesive layer 22.

Naturally, the removable printable sheet 4 may constitute an additional check level, to prevent fraudulent uses of the label.

Figure 6:
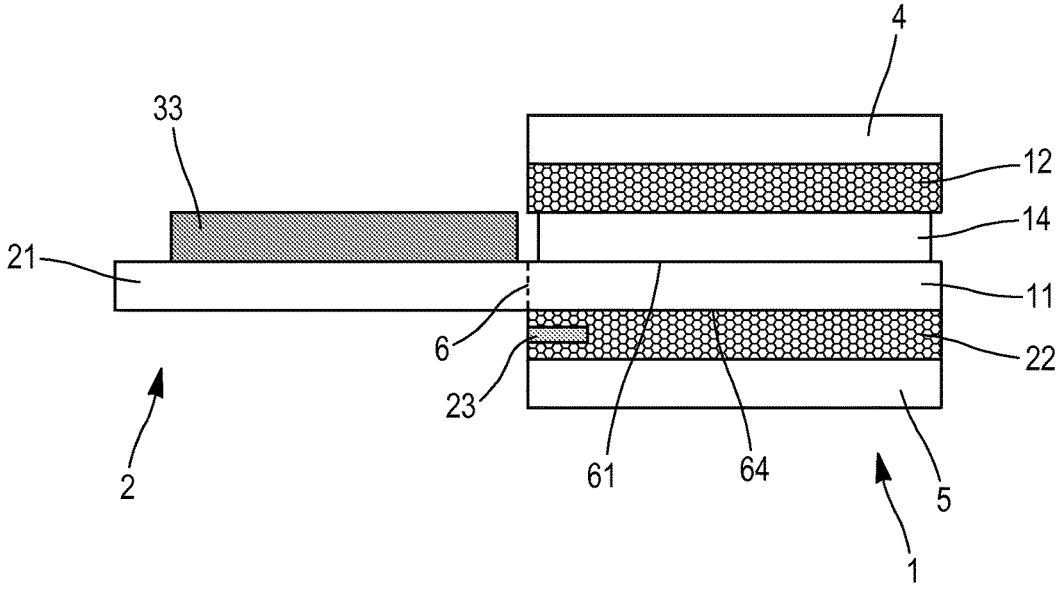
FIG. 6, a diagram of a secure label according to a preferred variant of the invention, in unfolded form.

FIG. 6 illustrates another variant of the invention in which the printable varnish 33 is opaque, the layer of coloured complex 14 is translucent and the second adhesive layer 22 is provided on the second face 64 of the transparent substrate 11 of the first flap 1. In this variant, the opaque printable varnish 33 reveals the colours of the translucent coloured complex 14. For example, a covering white varnish may be used as a printable varnish.

Following thorough research, the applicant has therefore developed a secure label that facilitates production of a receipt or counterfoil 4. Furthermore, the sealing of the label requires little manipulation. It allows simplified and precise folding and gluing compared with the prior art.

Another advantageous aspect of the secure label according to the invention relates to the optimisation of the materials. This is because a major part of the editable label is used and only the second protective layer 5 is finally scrapped. The doubly destructible character of the label, that is to say destructible in the case of falsification but also in the case of fraudulent reproduction, is entirely innovative and inventive.

Numerous combinations can be envisaged without departing from the scope of the invention; a person skilled in the art will choose one or the other according to the economic, ergonomic, dimensional or other constraints that he will have to comply with.

The invention claimed is:

1. A foldable prefabricated secure multilayer label intended to be stuck on a carrier, comprising:

integrated security means;

a transparent substrate separated by a folding line into a first flap and a second flap, the transparent substrate having a first face divided into a first face of the first flap and a first face of the second flap, and the transparent substrate having a second face divided into a second face of the first flap and a second face of the second flap, and wherein a surface printable material is provided on the first face of the second flap;

a first adhesive layer disposed opposite the entire first face of the first flap, the first adhesive layer protected by a first removable protective layer comprising a printable sheet, said first adhesive layer making it possible to stick together the first flap and the second flap when the first removable protective layer is removed and the first flap and the second flap are folded together; and a second adhesive layer disposed on the second face of one of the first flap and the second flap, the second adhesive layer protected by a second removable protective layer, said second adhesive layer making it possible to stick the label on the carrier, wherein the security means comprise at least one layer of destructible coloured complex interposed between the first face of the first flap and the first adhesive layer.

2. The secure label according to claim 1, characterised in that the printable material is translucent or transparent, the layer of coloured complex is opaque and said second adhesive layer is provided on the second face of the second flap.

3. The secure label according to claim 1, characterised in that the printable material is opaque, the layer of coloured complex is translucent and said second adhesive layer is provided on the second face of the first flap.

4. The secure label according to claim 1, characterised in that the security means further comprise a hologram integrated in the second adhesive layer.

5. The secure label according to claim 1, characterised in that the security means further comprise at least one RFID chip integrated in the second adhesive layer.

6. The secure label according to claim 1, in which the surface printable material on the first face of the second flap comprises a printable varnish.

7. A method for personalising and sealing a secure label intended to be stuck on a carrier, wherein the label comprises a transparent substrate separated by a folding line into a first flap and a second flap, the transparent substrate having a first face divided into a first face of the first flap and a first face of the second flap, and the transparent substrate having a second face divided into a second face of the first flap and a second face of the second flap, wherein a surface printable material is provided on the first face of the second flap;

wherein a first adhesive layer is disposed opposite the entire first face of the first flap, the first adhesive layer protected by a first removable protective layer comprising a printable sheet, said first adhesive layer making it possible to stick together the first flap and the second flap when the first removable protective layer is removed and the first flap and the second flap are folded together;

wherein at least one layer of destructible coloured complex is interposed between the first face of the first flap and the first adhesive layer;

and wherein a second adhesive layer is disposed on the second face of one of the first flap and the second flap, the second adhesive layer being protected by a second removable protective layer, said second adhesive layer making it possible to stick the label on the support, the method comprising steps for:

printing a set of identification data on the surface printable material provided on the first face of the second flap and on the printable sheet of the first removable protective layer, removing the first removable protective layer so that the first adhesive layer can be positioned facing said surface printable material, folding and gluing the first flap and the second flap together by pressing the first adhesive layer against the surface printable material.

8. The method according to claim 7, characterised in that the printing step is performed as windowphanie on the surface printable material.

9. The method according to claim 7, further comprising the steps of removing the second protective layer and then affixing the label on the carrier by pressing the second adhesive layer to the carrier.

10. The method of claim 7, in which the surface printable material on the first face of the second flap comprises a printable varnish.

11. The method according to claim 10, characterised in that the printing step is performed as windowphanie on the printable material.

12. A personalised sealed secure label intended to be stuck on a carrier, comprising:

label security means;

a transparent substrate separated by a folding line into a first flap and a second flap, the transparent substrate having a first face divided into a first face of the first flap and a first face of the second flap, and the transparent substrate having a second face divided into a second face of the first flap and a second face of the second flap, wherein a surface printable material is provided on the first face of the second flap, with identification data printed onto the surface printable material;

a first adhesive layer disposed opposite the entire first face of the first flap, the first adhesive layer protected by a first removable protective layer comprising a printable sheet, said first adhesive layer designed to stick together the first flap and the second flap when they are folded together; and a second adhesive layer disposed on the second face of one of the first flap and the second flap, the second adhesive layer protected by a removable protective layer, said second adhesive layer making it possible to stick the label on the carrier;

wherein the security means comprise at least one layer of destructible coloured complex interposed between the first face of the first flap and the first adhesive layer.

13. The secure label according to claim 12, in which the surface printable material on the first face of the second flap comprises a printable varnish.

* * * * *